United States Patent [19]

Miller

[11] Patent Number: 4,460,303

[45] Date of Patent: Jul. 17, 1984

[54] DRILL PIPE LOADER

[75] Inventor: James A. Miller, Strasburg, Ohio

[73] Assignee: Ingersoll-Rand Company, Woodcliff Lake, N.J.

[21] Appl. No.: 403,086

[22] Filed: Jul. 29, 1982

[51] Int. Cl.[3] ..... E21B 19/14

[52] U.S. Cl. ..... 414/22; 173/84; 175/85; 211/60 S

[58] Field of Search ..... 414/22, 745; 175/52, 175/85; 211/60 S; 173/81, 84; 294/90; 269/279, 280, 43

[56] References Cited

U.S. PATENT DOCUMENTS

| | | | |
|---|---|---|---|
| 2,909,288 | 10/1959 | Boudette | 414/22 X |
| 2,972,388 | 2/1961 | Thornburg | 414/22 X |
| 3,336,991 | 8/1967 | Klem et al. | 414/22 X |
| 3,913,753 | 10/1975 | Swartz et al. | 414/22 |
| 3,913,754 | 10/1975 | Swartz et al. | 414/22 |
| 3,985,189 | 10/1976 | Jahnke et al. | 414/22 X |

*Primary Examiner*—Leslie J. Paperner

*Attorney, Agent, or Firm*—Walter C. Vliet

[57] ABSTRACT

A drill pipe loader is disclosed having the capability of positioning and locking in place the top holder plate from a remote position therefrom independent of the lower cup plate.

7 Claims, 6 Drawing Figures

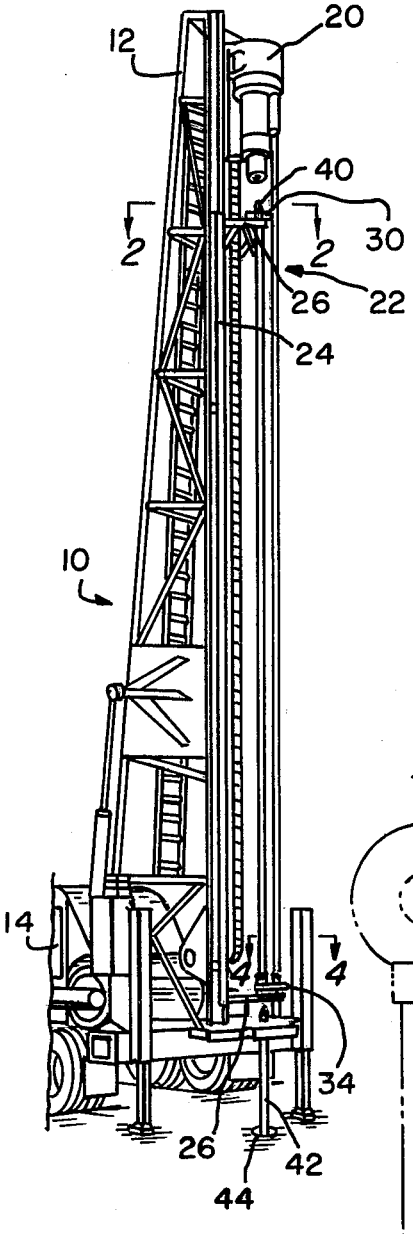
FIG. 1
FIG. 2
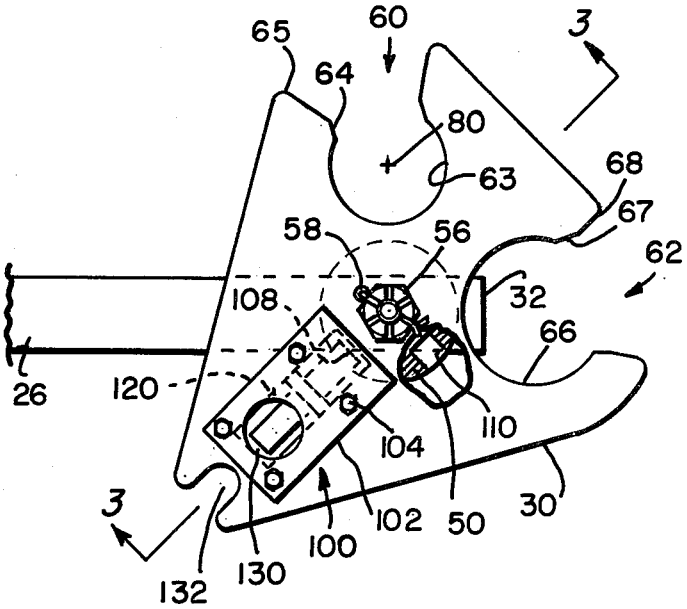
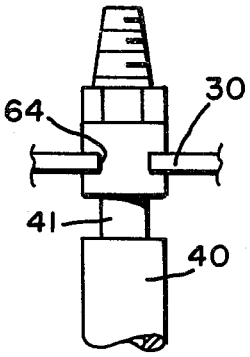
FIG. 1A
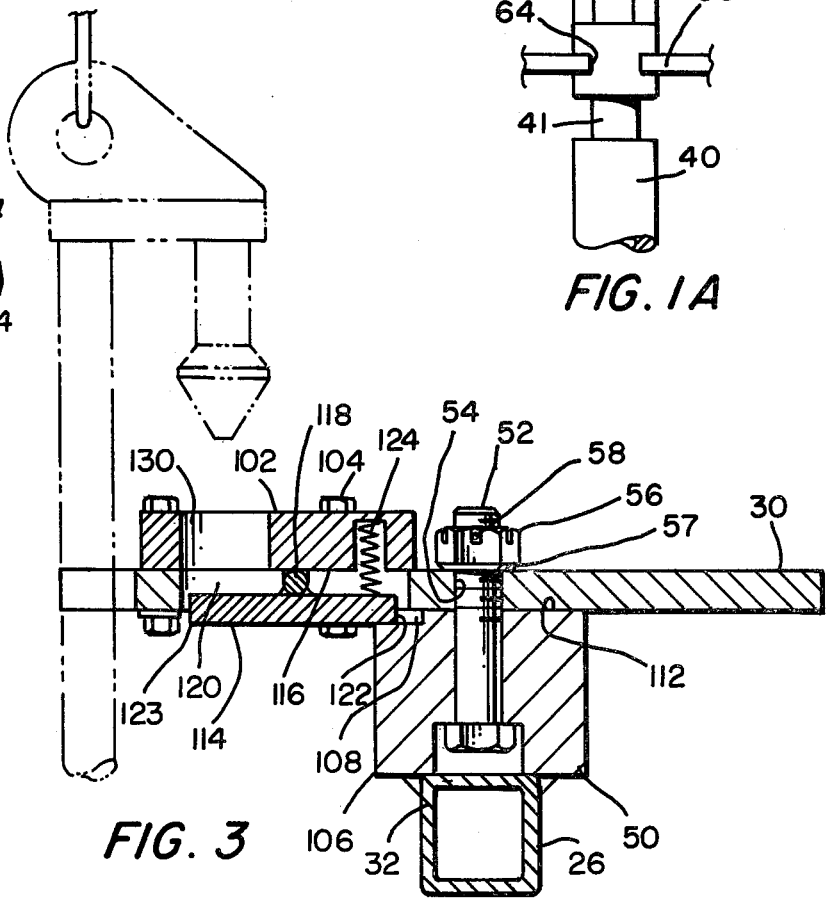
FIG. 3

DRILL PIPE LOADER

DESCRIPTION

Background of the Invention

This invention relates to drill pipe loaders for drilling rigs that are utilized for drilling holes in earth and rock. In starting a hole, it is usually necessary to add a quantity of drill collars to the drill string to provide sufficient weight so that a reasonable penetration rate can be achieved. As drilling progresses, and the depth of the hole increases, sufficient weight is eventually obtained to promote efficient drilling. From this point on sections of drill pipe are added to the drill string instead of additional drill collars. Since the collars are necessarily of a larger diameter than the drill pipe, the pipe loader must accomodate the two different sizes.

Carrousel type pipe loaders are generally utilized to accomodate both sizes. They may have several positions for drill pipe and one position for drill collars. The carrousel pipe loader has upper and lower indexing plates which are rigidly attached to a vertically disposed axle which permits the two plates to rotate together as a unit. The plates have suitable openings for holding and positioning the drill pipe. See for example, U.S. Pat. No. 3,913,753 issued Oct. 21, 1975 to Swartz et al and U.S. Pat. No. 3,985,189 issued Oct. 12, 1976 to Jahnke et al, both of which disclose carrousel pipe loaders.

When transporting the drill rig to the drilling site, the tower is arranged in a horizontal position parallel to the longitudinal axis of the truck with a portion of the upper most part of the tower extending forward of the front end of the truck. It is desirable to store the rotary drill head well down the tower toward the rear of the truck to distribute its very substantial weight, about 2500 pounds, across the rear axles. This procedure however, can be used only with drill pipe loaders of the type having independently pivotal upper and lower index plates.

In loaders of this type the upper index plate is typically not pivotable from the ground, requiring that someone climb the tower (about 40 feet high), manually actuate the latch, and pivot the upper plate to the desired position. Any axle connecting these plates, as in the carousel type loader, would interfere with the stored rotary drill head. In this case the drill head must be stored in the portion of the tower which extends forward of the front of the truck. This procedure, however, places an additional load of about 3000 pounds on the front axle of the truck thereby exceeding its maximum load limits. What is needed is a pipe loader having no connecting axle between the upper and lower index plates that may be easily and conveniently operated without resorting to climbing the tower or complex mechanisms.

It is therefore an object of this invention to provide a drill pipe loader in a rock drilling rig having independently pivoted upper and lower index plates of improved construction which permit storing of the rotary drill head in a position well down the tower.

It is another object of this invention to provide a drill pipe loader wherein the upper index plate may be pivoted from a convenient position near the operator's work station.

It is another object of this invention to provide a drill pipe loader that is operable from the operator's work station without the need for complex remote control devices.

SUMMARY OF THE INVENTION

According to the present invention, there is provided a drill pipe loader device for positioning drill pipe in a rotary earth boring machine of the type having a rotary drilling head. A vertical tower supports the drill pipe loader, and the rotary drilling head. A drilling means is supported for vertical movement within the tower and arranged for boring a hole in the earth on a predetermined bore axis. The drill pipe loader comprises a top holder plate, a lower cup plate, and a support means hingably attached to the tower for pivotally and independently supporting the top holder plate and the lower cup plate means spaced apart and in mutual vertical alignment for supporting the weight of the drill pipe while being positioned. The top holder plate has a plurality of openings formed therein and arranged so that as the top holder plate is pivoted, the openings come into alignment with the bore axis in seriatum.

DESCRIPTION OF THE DRAWINGS

Other objects, features, and advantages will become more apparent upon reading the following detailed description in conjunction with the accompanying drawings in which:

FIG. 1 is a partial perspective view of a drilling rig showing a tower, a rotary drilling head, and a drill pipe loader;

FIG. 1A is a side elevation of the top holder showing a portion of a drill pipe disposed therein;

FIG. 2 is a plan view of the top holder plate taken along the lines 2—2 of FIG. 1;

FIG. 3 is a cross section view taken along the lines 3—3 of FIG. 2;

DESCRIPTION OF THE PREFERRED EMBODIMENT

Figure 4:
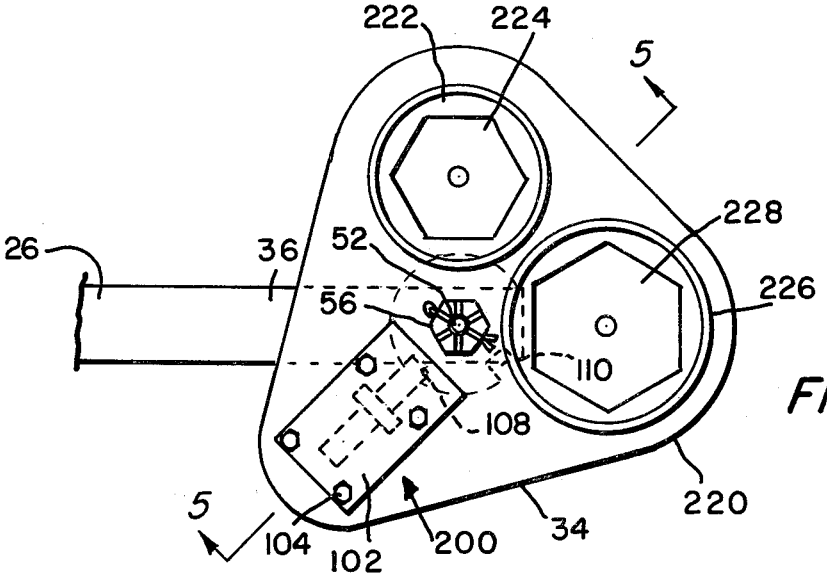
FIG. 4 is a plan view of the lower cup plate means taken along the lines 4—4 of FIG. 1.

Referring to FIG. 1 there is shown a portion of a drill rig 10 having a tower structure 12 mounted on a vehicle 14 and arranged in a vertical postion for drilling a hole in the earth. A rotary drilling head 20 is supported on the tower for vertical movement in a manner that is notoriously well known in the art. A drill pipe loader 22 is shown having a vertically disposed elongated member 24 which is supported on the tower or hingably attached thereto for pivotal movement along its longitudinal axis. A pair of brackets 26 are rigidly attached to the two extremities of the elongated member 24, project horizontally outwardly and are in mutual vertical alignment. A top holder or index plate 30 is pivotally attached to the free end 32 of the top one of the pair of brackets 26 and a lower cup plate 34 is pivotally attached to the free end 36 of the lower one of the brackets 26. A section of drill pipe 40 is shown retained in the drill pipe loader 22 preparatory to attaching its lower end to a drill pipe string 42 projecting out of a bore hole 44 and attaching its upper end to the rotary drilling head 20.

Referring to FIGS. 2 and 3, a cylindrical shaped boss 50 is rigidly attached to the free end 32 of the top bracket 26, as with welding for example, and has a threaded stud 52 projecting upwardly coincident with the cylindrical axis of the boss 50. The top holder plate 30 has a hole 54 through which the stud 52 projects. A nut 56, washer 57, and cotter pin 58 snugly retain the top holder plate 30 to the boss 50 while permitting it to freely pivot about the stud 52. Two openings 60 and 62 formed in the plate 30 are shaped to retain the drill pipe 40 while positioning the pipe and connecting it to the drill string. The opening 60 has a circular portion 63 for loosely embracing the outer diameter of the drill pipe and a reduced opening 64, and guide flanges 65. A reduced diameter 41 formed in the drill pipe 40 is smaller than the reduced opening 64 so that the drill pipe can be maneuvered between the guide flange 65, into the opening 60, and then lowered until the outer diameter of the drill pipe 40 engages the circular portion 64. The reduced opening 64 then retains the drill pipe in place, see FIG. 1A. Similarly, the opening 62 has a circular portion 66, a reduced opening 67, and guide flanges 68 but of somewhat larger dimensions than those of the opening 60 to accomodate the larger diameter of the drill collar.

With the elongated member 24 and associated brackets 26 in loading position, as shown in FIGS. 1 and 2, the top holder plate 30 can be pivoted about the stud 52 until the circular portion 63 is in alignment with the bore axis 80. A latch means 100, see FIGS. 2 and 3, includes a bracket 102 rigidly fastened to the top holder plate 30 with four screw fasteners 104, a striker member 106 comprising a portion of the boss 50 and having a pair of notches 108 and 110 formed in the top surface 112 thereof, and an elongated latch member 114. The latch member 114 is pivotally attached to the underside 116 of the bracket 102 by any suitable means such as a hinge 118. One of each hinge half is welded to the latch member 114 and the underside 116 respectively to provide rigidity in the plane that is perpendicular to the direction of pivotal movement.

A rectangular cutout 120 is formed through the top holder plate 30 to accomodate the latch member 114 with substantial clearance on all sides thereof. One end 122 of the latch member 114 is adapted to lockingly engage each of the pair of notches 108 and 110. A suitable spring 124 is arranged to urge the end 122 into such locking engagement. This effectively prevents pivotal movement of the top holder plate 30 when attaching a section of drill pipe to the drill string or removing one therefrom. A hole 130 is provided in the bracket 102 directly above the other end 123 of the latch member 114. The hole 130 is dimensioned to loosely receive the end of a pipe handling tool that is supported by a jib hoist cable. Both the pipe handling tool and the jib hoist cable are shown in phantom lines in FIG. 3. An opening 132 is formed in the edge of the top holder plate 30 adjacent the latch member 114 and is adapted to loosely receive a portion of the pipe handling tool to aid in guiding the end of the tool into the hole 130.

Figure 5:
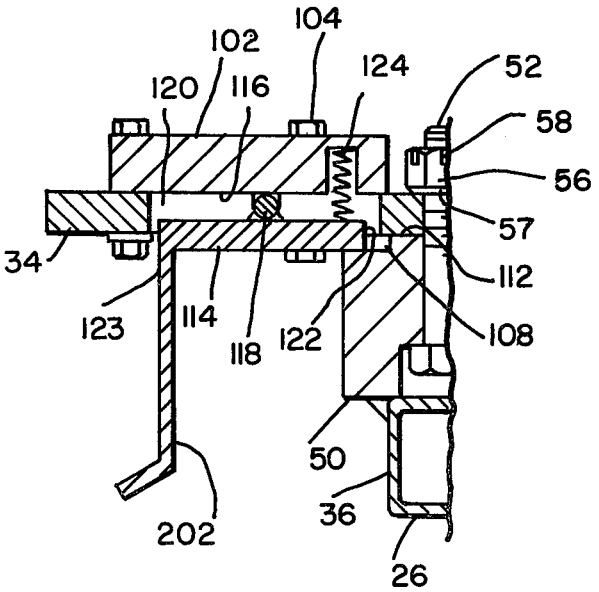
FIG. 5 is a cross section view taken along the lines 5—5 of FIG. 4.

Referring now to FIGS. 4 and 5, there is shown the lower cup plate 34 pivotally attached to the free end 36 of the lower one of the pair of brackets 26. Pivotal attachment is achieved utilizing the stud 52, nut 56, washer 57, and cotter pin 58 in a manner similar to that described above for the top holder plate 30. A lower latch means 200 is attached to the lower cup plate 34 by the screw fasteners 104 and is similar to the latch means 100 in both structure and details of operation. As with the latch means 100, the lower latch means 200 includes the bracket 102, the elongated latch member 114, the hinge 118, and the spring 124. The end 122 of the latch member 114 is adapted to lockingly engage each of the pair of notches 108 and 110 which are formed in the top surface of the boss 50. The boss 50 is rigidly attached to the free end 36 of the lower bracket 26. The elongated latch member 114, has projecting from its end 123, a foot pedal 202 which projects down and outwardly for convenient access by the operator.

The lower cup plate 34 includes two upwardly facing cups that are rigidly attached to the upper surface 220 of the plate 34. The first cup 222 has an upwardly open cavity 224 of hexogonal shape and is dimensioned to accept insertion of the female end of the drill pipe section 40. The second cup 226 similarly has an upwardly open cavity 228 of hexagonal shape and is of somewhat larger dimensions to accept insertion of the female end of a drill collar. A drill collar is similar to a section of drill pipe except that it is of larger outside diameter and has a thicker wall. It is used in place of drill pipe in the early stages of drilling a hole to apply more weight to the bit. Further, the two cups are arranged on the plate 34 so that when the end 122 of the latch member 114 has lockingly engaged the notch 108, the first cup 222 is in alignment with the bore axis 80 and when the end 122 has lockingly engaged the notch 110 the second cup 226 is in alignment with the bore axis 80.

In operation, drill collars are placed in the drill pipe loader and assembled to the drill string in a manner well known in the art. During this operation the top holder plate 30 and the lower cup plate 34 are positioned so that the opening 62 and the cup 226 are in alignment with the bore axis 80. When it is desired to begin using drill pipe, the operator simply aligns the handle of the pipe handling tool in the opening 132 and inserts the end of the tool into the hole 130. The weight of the pipe handling tool, overcoming the biasing force of the spring 124, depresses the end 123 of the latch member 114 and unlocks the latch means 100. The operator, by manipulating the handle of the pipe handling tool, causes the top holder plate 30 to pivot until the opening 60 is in alignment with the bore axis 80. The pipe handling tool is then raised allowing the latch member 114 to lockingly engage the notch 110. The latch means 200 is then unlocked by depressing the foot pedal 202 and the lower cup plate 34 pivoted until the cup 222 is in alignment with the bore axis 80. Drill pipe may then be placed in the drill pipe loader and assembled to the drill string in the conventional manner.

Accordingly, there has been disclosed a drill pipe loader having the capability of positioning and locking in place the top holder plate from a remote position therefrom independent of the lower cup plate. It is understood that the above described embodiment is merely illustrative of the application of the principles of this invention. Upon reviewing the present disclosure numerous other embodiments may be devised by those skilled in the art without departing from the spirit and scope of this invention, as defined by the appended claims.

I claim:

1. A drill pipe loader device for positioning drill pipe in a rotary earth boring machine of the type having a rotary drilling head, a vertical tower for supporting said drill pipe loader and said rotary drilling head, and a drilling means supported for vertical movement within said tower and arranged for boring a hole in the earth on a predetermined bore axis, said drill pipe loader comprising:

a. a vertically disposed enlongated member having an upper end and a lower end pivotally supported along its longitudinal axis on said tower;

b. a pair of brackets rigidly attached to said elongated member and projecting outwardly, the first bracket attached to said upper end and the second bracket attached to said lower end and arranged in mutual vertical alignment;

c. a top holder plate pivotally supported on said first bracket and spaced apart from said elongated member, said plate having a plurality of openings formed therein and arranged so that as said plate is pivoted, said plurality of openings come into alignment with said bore axis in seriatim;

d. lower cup plate.means pivotally attached to said second bracket independent of said top holder plate for supporting the weight of said drill pipe while being positioned;

e. latch means for releasably locking said top holder plate to prevent pivoting thereof when at least one of the said plurality of openings is in said alignment with said bore axis;

f. said latch means further comprising a striker member having at least one locating depression formed in a surface thereof and a latch member being pivotally supported and arranged to lockingly engage said locating depression to prevent said pivoting of said top holder plate, said elongated latch member is pivotally supported on said top holder plate and is constrained to pivot about a single pivot axis; and h. a guide means for positioning a pipe handling tool so that an end thereof engages said latch member and causes said latch member to pivot about said single pivot axis and disengage with said locating depression.

2. A drill pipe loader device for positioning drill pipe in a rotary earth boring machine of the type having a rotary drilling head, a vertical tower for supporting said drill pipe loader and said rotary drilling head, and a drilling means supported for vertical movement within said tower and arranged for boring a hole in the earth on a predetermined bore axis, said drill pipe loader comprising:

a. a top holder plate and a lower cup plate means;

b. support means hingably attached to said tower for pivotally supporting said top holder plate and pivotally supporting said lower cup plate means spaced apart from said top holder plate and in vertical alignment therewith for supporting the weight of said drill pipe while being positioned;

c. said top holder plate having a plurality of openings formed therein and arranged so that as said top holder plate is pivoted, said plurality of openings come into alignment with said bore axis in seriatum; and d. said top holder plate being pivotally supported independently of said lower cup plate means;

e. latch means for releasably locking said top holder plate to prevent pivoting thereof when at least one of the said plurality of openings is in said alignment with said bore axis.

f. said latch means further comprising a striker member having at least one locating depression formed in a surface thereof; and g. an elongated latch member having a first extremity and a second extremity and being pivotally supported intermediate said first and second extremities and arranged so that said first extremity lockingly engages said locating depression to prevent said pivoting of said top holder plate, said elongated latch member is pivotally supported on said top holder plate and is constrained to pivot about a single pivot axis;

h. a guide means for positioning a remotely operated pipe handling tool so that an end thereof engages said second extremity and causes said elongated latch member to pivot about said single pivot axis.

3. A drill pipe loader device as set forth in claim 2 wherein said latch means further comprises a resilient means for urging said first extremity of said latch member into said locking engagement with said locating depression.

4. A drill pipe loader device as set forth in claim 3 wherein said latch means is arranged so that said single pivot axis is perpendicular to said bore axis and when said second extremity is urged in a direction toward said lower cup plate means said elongated latch member pivots about said single pivot axis in opposition to said resilient means thereby moving said first extremity out of said locking engagement with said locating depression.

5. A drill pipe loader device as set forth in claim 2 wherein said guide means comprises:

a. an opening formed in a bracket adjacent said second extremity of said elongated latch member, said opening loosely accepting insertion of an end of said pipe handling tool; and b. an open ended hole formed in said top holder plate in radial alignment with said opening formed in said bracket and said bore axis, said open ended hole loosely accepting insertion of the shank of said pipe handling tool.

6. A drill pipe loader device as set forth in claim 5 wherein said latch means further comprises a guide means for positioning a pipe handling tool so that movement of said pipe handling tool in a direction toward said lower cup plate means will unlock said latch means and thereby permit said pivoting of said top holder plate.

7. A drill pipe loader device as set forth in claim 6 wherein said guide means comprises:

a. an opening formed in said bracket adjacent said extremity of said elongated latch member, said opening loosely accepting insertion of an end of said pipe handling tool; and b. an open ended hole formed in an edge of said top holder plate, said open ended hole loosely accepting insertion of the shank of said pipe handling tool.

* * * * *